US005986529A

United States Patent [19]

Miyata et al.

[11] Patent Number: 5,986,529

[45] Date of Patent: Nov. 16, 1999

[54] ELECTROMAGNETIC RELAY

[75] Inventors: Hirotaka Miyata; Masanori Nakamura; Hironori Sanada; Masahiro Kuwahara; Masahiko Tashiro, all of Kyoto, Japan

[73] Assignee: Omron Corporation, Kyoto, Japan

[21] Appl. No.: 09/017,253

[22] Filed: Feb. 2, 1998

[30] Foreign Application Priority Data

Jan. 31, 1997 [JP] Japan ..... 9-018513

[51] Int. Cl.[6] ..... H01H 51/22

[52] U.S. Cl. ..... 335/78; 335/80; 335/81; 335/82; 335/83; 335/84; 335/85; 335/86; 335/129; 335/133

[58] Field of Search ..... 335/78–86, 128, 335/129, 133

[56] References Cited

FOREIGN PATENT DOCUMENTS 40 35 586 6/1991 Germany .

43 09 618 9/1994 Germany .

*Primary Examiner*—Lincoln Donovan
*Assistant Examiner*—Tuyen T. Nguyen
*Attorney, Agent, or Firm*—Morrison & Foerster LLP

[57] ABSTRACT

An inexpensive electromagnetic relay with a simple configuration is provided which does not require a sliding core to attain the desired operating characteristics. The electromagnetic relay includes a movable component which is supported on an upper end of a coil block in a way that the movable component can freely rotate. The movable component further comprises a movable contact element and a movable iron member. The movable contact element and the movable iron member are isolated from each other by a retainer. The movable contact element, movable iron member and retainer all form a single piece. The retainer further comprises a first retainer portion for retaining the movable contact element, and a second retainer portion for retaining the movable iron member. The first and second retainer portions are also formed into a single piece.

8 Claims, 7 Drawing Sheets

ELECTROMAGNETIC RELAY

FIELD OF THE INVENTION

This invention generally relates to electromagnetic relays and, more specifically, to an electromagnetic relay with a movable component in which a movable contact element and a movable iron member are integrally formed but yet isolated from each other.

BACKGROUND OF THE INVENTION

An example of a prior art electromagnetic relay is shown in FIG. 9. Movable component 3 is supported by an upper end of coil block 2 in a way that it is free to rotate; coil block 2 is set on base 1. Movable component 3 comprises movable contact element 4 and movable iron member 5, which are held together and isolated from each other by resin retainer 6. Movable component 3 has several parallel movable contact elements 4, which are formed integrally to retainer 6 by an insert molding process. Movable iron member 5 is securely attached so as to be integral to the same retainer 6.

In the absence of magnetic excitation, the restoring force of spring 7 in FIG. 9 causes coil block 2 of this electromagnetic relay to rotate counterclockwise. Movable contact 4*a* on the lower end of movable contact element 4 comes in contact with fixed contact 8*a* on fixed terminal 8, which is pressed into base 1. When a current is applied to coil block 2, the movable iron member 5 is drawn toward core 9, which projects from the end of the coil block 2. Movable component 3 then rotates clockwise, and the movable contact 4*a* comes in contact with the other fixed contact, contact 10*a* on fixed terminal 10.

With the electromagnetic relay described above, the limitations of precision inherent in the pressing process result in variations in the thickness of both the sheet used for movable iron member 5 and its plating (on the order of ±0.05 mm). These variations adversely affect the distance between surface 5*a* of movable iron member 5 and movable contact element 4 when member 5 is directly attracted to core 9, and consequently they adversely affect the positional relationship between the surface 5*a* and movable contact 4*a*. In other words, imprecision in the thickness of member 5 may lead to variations in the distance between movable contact 4*a* and fixed contact 10*a* or in the force of contact between the two. For at least this reason, it is necessary in the prior art to adjust the relay manually in an afterprocess in order to attain the desired operating characteristics.

To ensure that movable contact element 4 and movable iron member 5 are properly isolated from each other, it is necessary to create a specified gap g between the two, as shown ir FIG. 10(*b*). Thus if the mold used to form the retainer 6 is moved in the direction shown by arrow b—b, it would not be possible to achieve the gap g. It is thus necessary to use a thin sliding core (not pictured) which could move in direction a—a shown in FIG. 10(*a*). This would make it more complex to construct the molds and, therefore, drive up the cost.

Accordingly, there exists a need for an inexpensive electromagnetic relay with a simple configuration which does not require a sliding core to attain the desired operating characteristics.

SUMMARY OF THE INVENTION

An electromagnetic relay of the invention has a movable component comprising a movable contact element and a movable iron member which are held in place by a retainer in a way that they are isolated from each other. The movable contact element and the movable iron member are integrally formed with that retainer. The movable component is supported on an end of a coil block in a way that it can freely rotate. The retainer further comprises a first portion for holding the movable contact element in place, and a second portion for holding the movable iron member in place. The two portions are formed as a single piece.

It is desirable that the two portions of the retainer are attached to each other in a postforming process.

Moreover, it is desirable to form a projection to serve as a provisional anchor on one of the two portions of the retainer. This projection then engages in a hole on the other portion to fasten the two portions together prior to postforming.

Other embodiments of attaching the two portions of the retainer together include: inserting the projection on one of the two portions of the retainer into the hole on the other portion and caulking the projection; thermally caulking a depression provided on a tip of the projection; and inserting a rivet through a hole which has been cut through both portions of the retainer and then caulking the rivet.

Ideally, a hole should be provided through the projections in the two portions of the retainer, which hole surrounds and holds an indicator in a way that it can freely rotate.

The above features and advantages of the invention will be better understood from the following detailed description taken into conjunction with the accompanying drawings.

BRIEF DESCRIPTION OF THE DRAWINGS

FIG. 2(*a*) illustrates the state of the components before the primary molding process.

FIG. 2(*b*) illustrates their appearance after the primary molding process.

FIG. 2(*c*) illustrates the movable iron member before the primary molding process.

FIG. 2(*d*) illustrates the iron member after the primary molding process.

FIG. 2(*e*) illustrates the completed movable block.

FIG. 5(*b*) illustrates a cross section taken along line A—A in FIG. 5(*a*).

FIG. 10(*b*) is a lateral view of the component in FIG. 10(*a*).

DETAILED DESCRIPTION OF THE INVENTION

Several embodiments of the invention with reference to the appended drawings are now explained.

Figure 1:
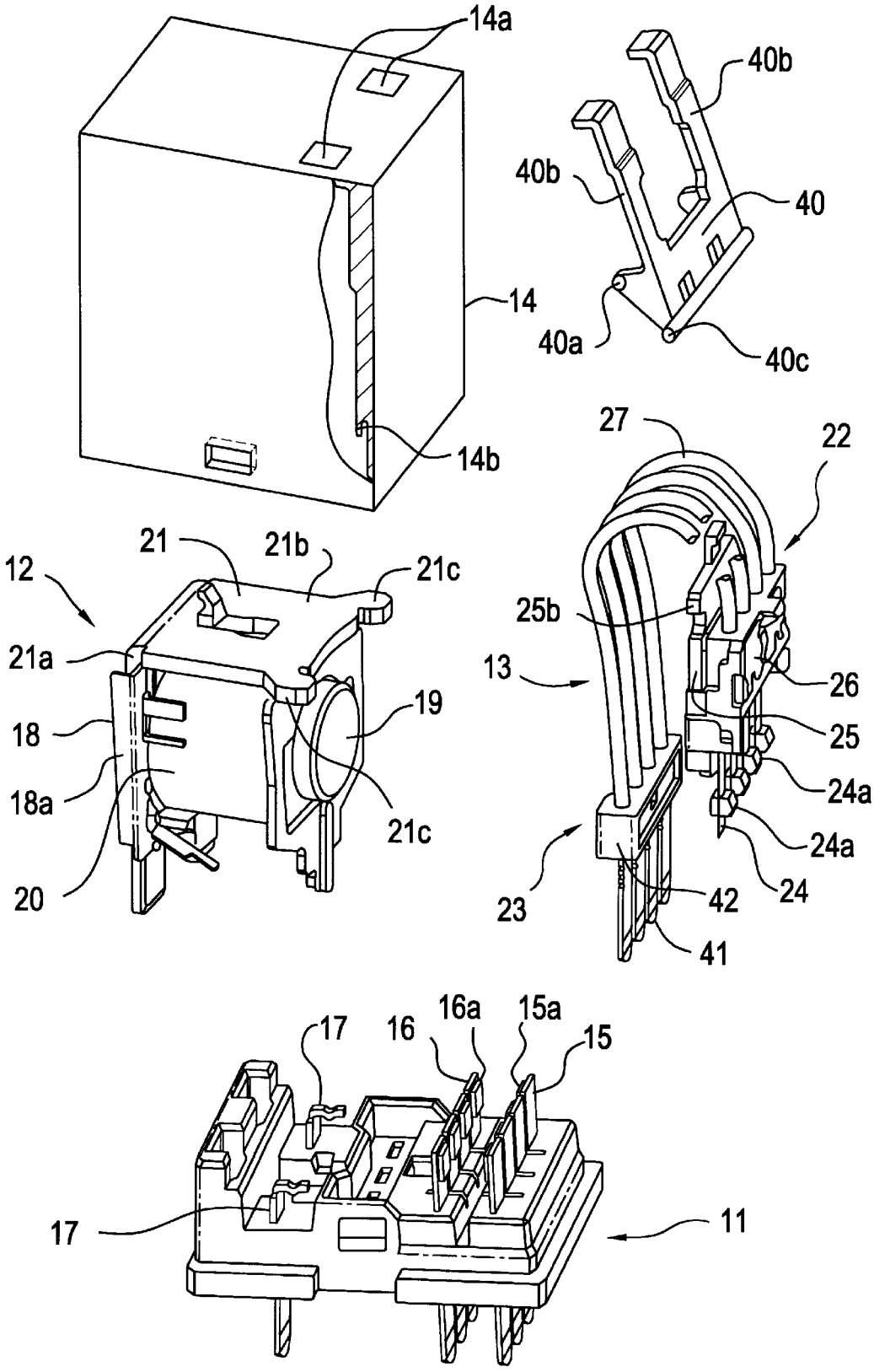
FIG. 1 is an exploded perspective view of an electromagnetic relay in an ideal embodiment of this invention.
Figure 2A:
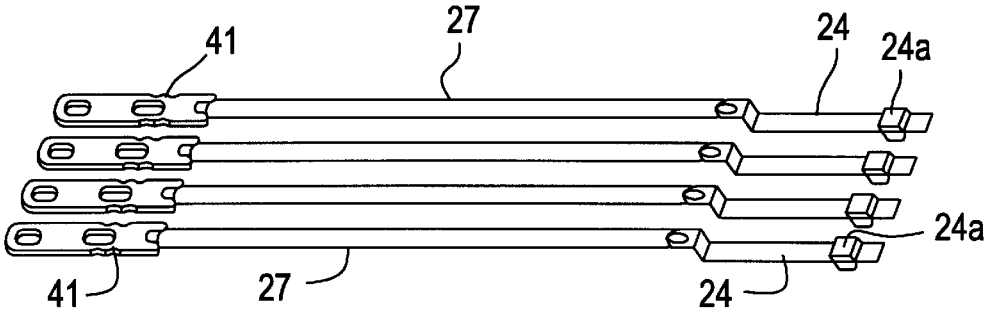
FIG. 2 is a perspective drawing illustrating the process of producing the movable block shown in FIG. 1.
Figure 2B:
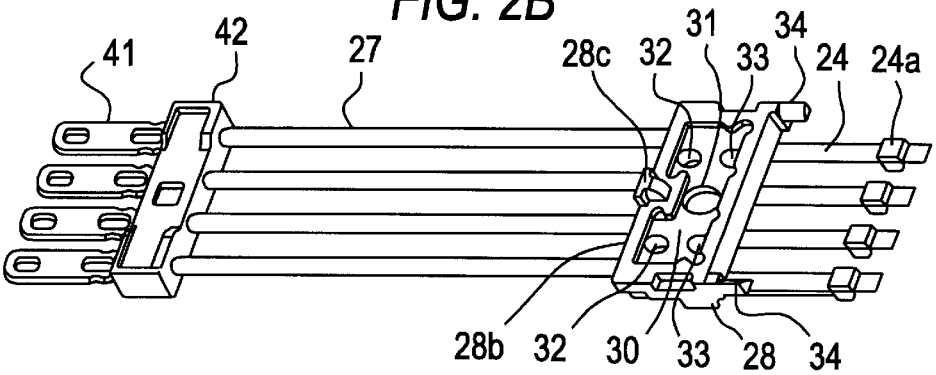
Figure 2C:
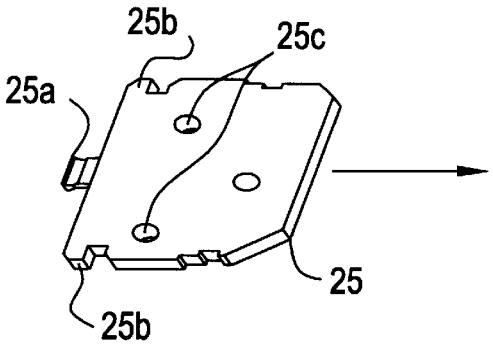
Figure 2D:
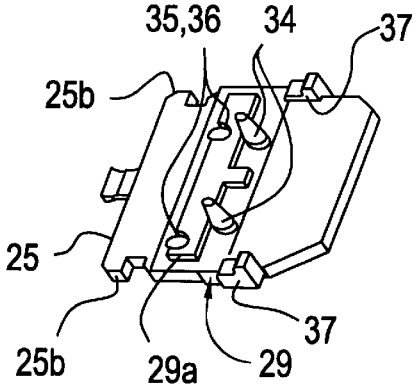
Figure 2E:
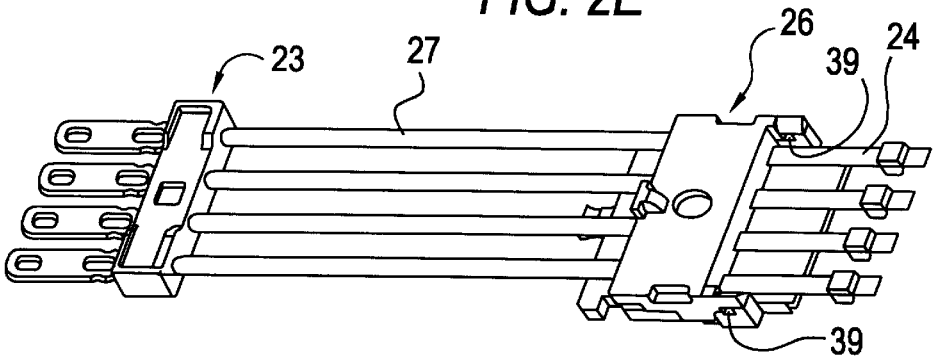

FIG. 1 illustrates an ideal embodiment of an electromagnetic relay of the invention. It comprises primarily of base 11, coil block 12, movable block 13 and case 14.

Base 11 is a rectangular plate. On one end of this plate are four sets of fixed terminals 15 and 16 which are pressed into the base. Fixed contacts 15*a* and 16*a*, which are on these terminals, face each other with a prescribed gap between them. On the other end of base 11 are two coil terminals 17, which are pressed into the base close to its edges.

In coil block 12, core 19 is inserted into and through spool 18, and coil 20 is wound around it. An end of core 19 which projects beyond flange 18*a* of spool 18 is caulked to vertical wall 21*a* of yoke 21, which is attached to the base 11.

Movable block 13 comprises movable component 22 and terminal 23.

Movable component 22 comprises four movable contact elements 24 and movable iron member 25, which are formed integrally with retainer 26. Referring to in FIG. 2(*a*), movable contacts 24*a* are on the corresponding ends of movable contact elements 24. Lead wires 27 are connected to the other ends of the elements.

Referring to in FIG. 2(*c*), movable iron member 25 has a tab 25*a* protruding from the middle of one end. On either side of this tab are fulcrum ends 25*b*. Holes 25*c* are provided in two locations on top of the movable iron member 25. Fulcrum ends 25*b* of the movable member 25 are supported by tabs 21*c* on the ends of horizontal wall 21*b* of yoke 21.

Retainer 26 comprises first retainer portion 28 and second retainer portion 29 (see FIGS. 2(*b*), 2(*d*) and 2(*e*)).

Figure 3:
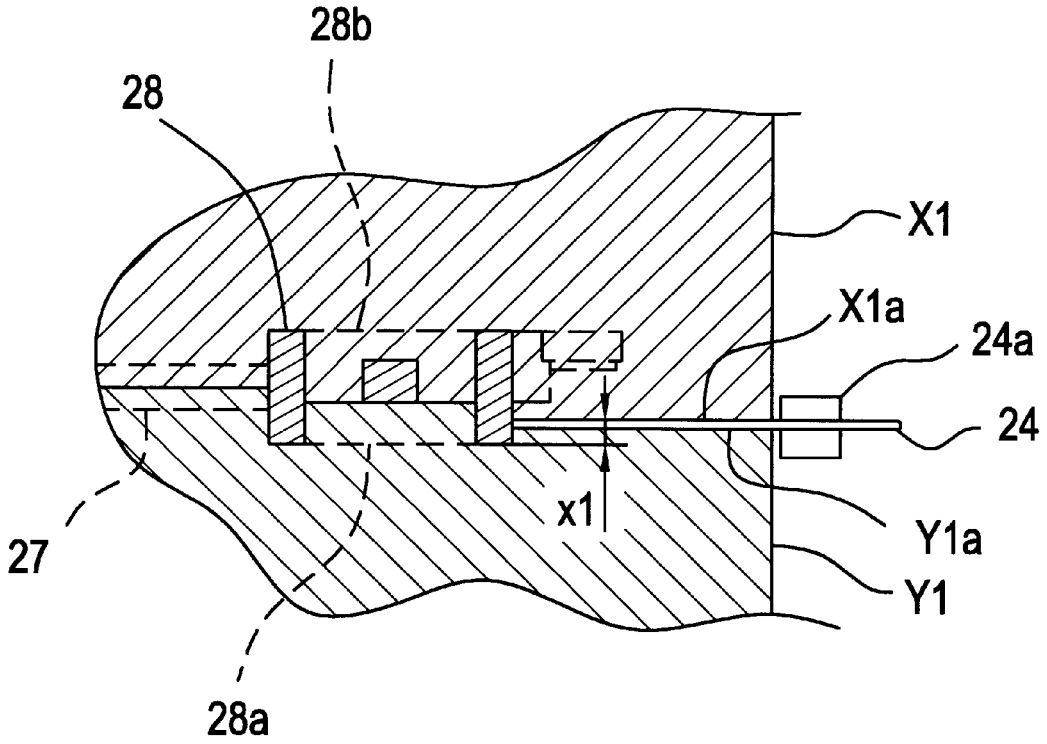
FIG. 3 illustrates a cross section of the mold for the first retailer portion used in the primary molding process.

First retainer portion 28, as shown in FIG. 2(*b*), has an array of four movable contact elements 24 at prescribed intervals. These contact elements 24 are insert-molded into the connector portions of lead wires 27 in a primary molding process. Since there are no parts which require a sliding core as in the prior art, the primary molding process can be accomplished using two simply configured molds $X_1$ and $Y_1$, as illustrated in FIG. 3. Furthermore, the retainer can be molded with portions of movable contact elements 24 touching the inner surface $Y_1$a of the cavity of direct mold $Y_1$. Thus the distance $X_1$ between movable contact element 24 and the surface (surface 28*a*) of first retainer portion 28 can be kept within the range of allowable error in the molding process (in this embodiment, ±0.005 mm). In the center of the edge of the opposite surface (exposed surface 28*b*) of the first retainer portion 28, a protrusion 28*c* is formed (see FIG. 2(*b*)). Most of this surface is recessed to form depression 30. In the center of depression 30 is resin hole 31. On either side of protrusion 28*c* are resin holes 32. On either side of resin hole 31 are two connector holes 33. Projections 34 extend from two corners of first retainer portion 28.

Figure 4:
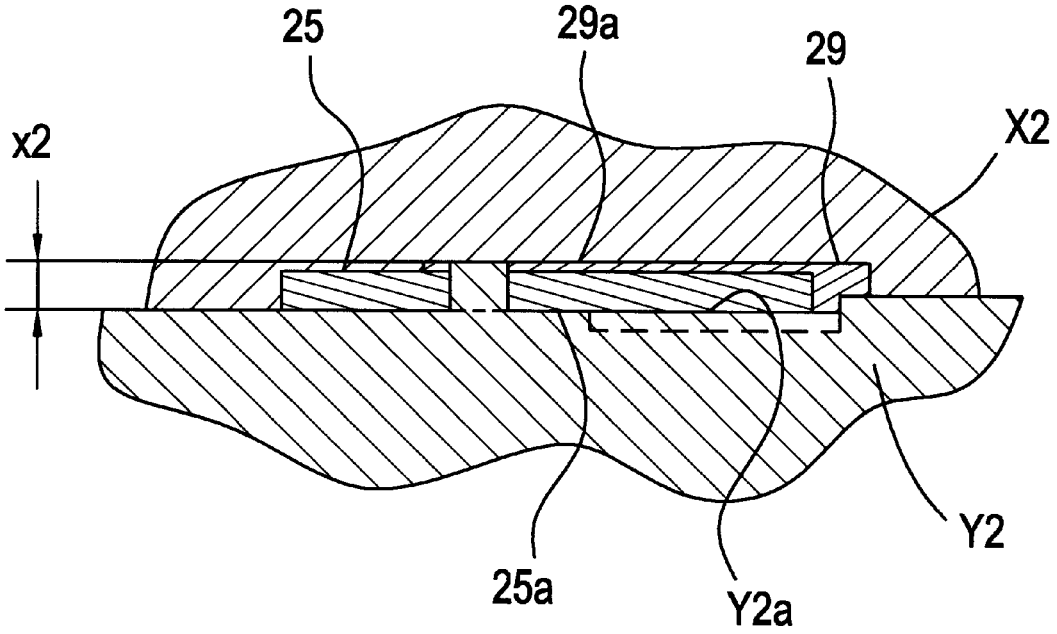
FIG. 4 illustrates a cross section of the mold for the second retainer portion used in the primary molding process.

In contrast to the first retainer portion 28, second retainer portion 29 is insert-molded in a primary molding process to form movable iron member 25 as a single piece. There is no need for a sliding core as in the prior art in this primary molding process. Referring to in FIG. 4, second retainer portion 29 can be molded with adsorbent surface 25*a* of movable iron member 25 in direct contact with inner surface $Y_2$a of the cavity of mold $Y_2$. Thus any variations in the thickness of the sheet or the plating of member 25 will be absorbed in the molding process. As a result, the distance $X_2$ between the adsorbent surface 25*a* of the member 25 and the opposing surface on the other side of member 25 (contacting surface 29*a*) can be kept within the permissible range of error (in this embodiment, ±0.005 mm) by the molding process. On contacting surface 29*a* of the second retainer portion 29, as shown in FIG. 2(*d*), are two projections 34 which engage in holes 33 in the first retainer portion 28. This surface also has two through holes 35. When these through holes 35 are lined up with through holes 25*c* in the movable iron member 25, they form resin holes 36. On the opposite edges of second retainer portion 29 are two L-shaped protrusions 37.

The first and second retainer portions 28 and 29 are then formed into a single piece by means of an insert molding process (postforming). The first step in this secondary process is to put surface 28*a* of the first retainer portion 28 in contact with surface 29*a* of the second retainer portion 29. Projections 34 on the second retainer portion 29 will engage in holes 33 in the first retainer portion 28 to temporarily anchor the two portions to each other. In this temporarily anchored state, as was discussed earlier, the dimension from movable contact element 24 to surface 28*a* of the first retainer portion 28, and the dimension from adsorbent surface 26*a* of the movable iron member 25 to surface 29*a* of the second retainer portion 29 are determined with a very high degree of precision. Thus the dimension from movable contact element 24 to adsorbent surface 25*a* of movable contact element 25 is also precisely determined.

Figure 5A:
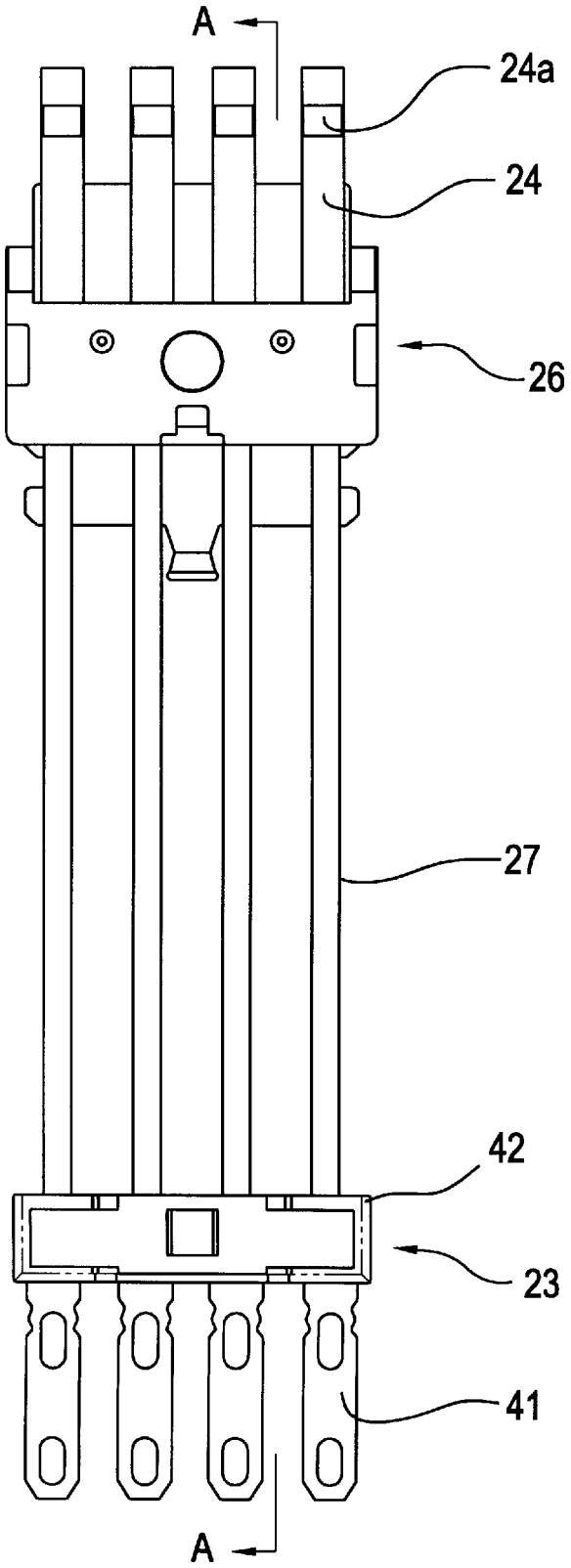
FIG. 5(*a*) is a plan view of the movable block in FIG. 1.
Figure 5B:
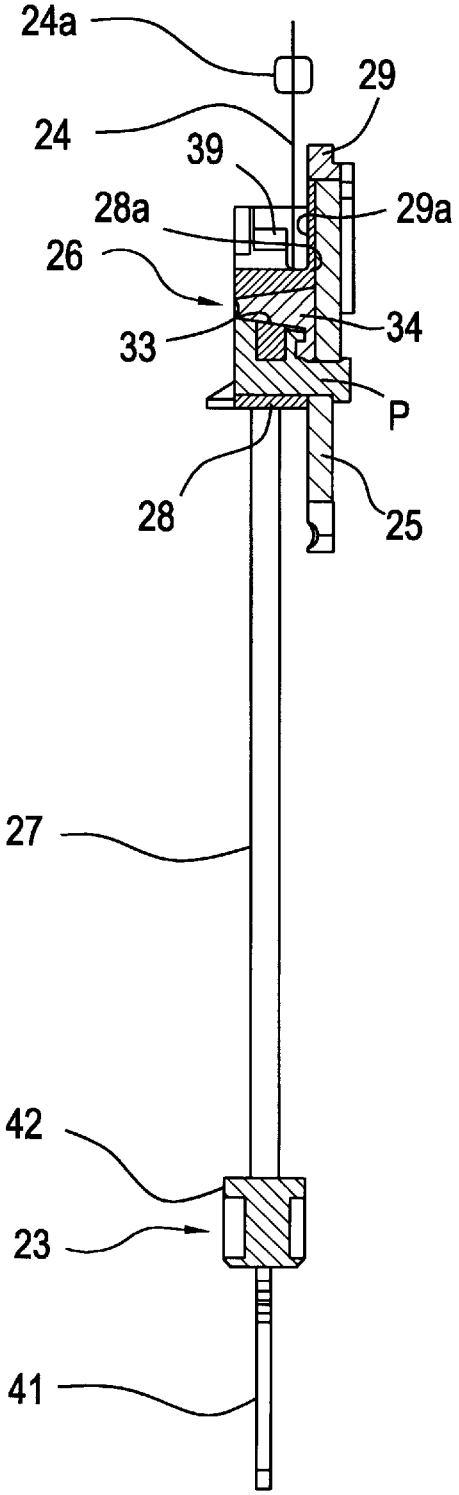

The two temporarily anchored portions of the first and second retainer portions 28 and 29 are then placed in a cavity of a mold (not pictured) and the secondary molding process is executed. A resin P which is poured into the mold (see FIG. 5(*b*)) fills depression 30 in the first retainer portion 28. It flows through resin hole 31 and then through holes 32 and 36 until it reaches the second retainer portion 29. The resin which flows through resin hole 31 goes beyond second retainer portion 29 and spreads wider than the diameter of hole 31. In this way, the first and second retainer portions 28 and 29 are permanently joined together.

Movable component 22, then, is created by forming the first and second retainer portions 28 and 29 into a single piece. Fulcrum ends 25*b* (see FIG. 1) which support component 22 are themselves supported by tabs 21*c* of yoke 21 in a way that they are free to rotate. Spring 38 imparts force in the counterclockwise direction as shown in FIG. 6.

Operating indicator 40 is seated in support hole 39, which is formed from projections 34 on the first retainer portion 28 and protrusions 37 on the second retainer portion 29. Indicator 40 can freely rotate about its axis, shaft 40*a*, as shown in FIG. 6. Operating indicator 40 has two arms 40*b* which extend upward, and a shaft 40*c* which protrudes to either side on its lower end.

Terminal 23 has four rotor terminations 41 arranged in a row (see FIG. 2(*e*)). These terminations are connected, respectively, to the other ends of the lead wires 27 which come from the movable contact elements 24. Terminal 23 is formed integrally with retainer component 42 during the primary molding process. Component 42 is pressed into a prescribed location on base 11; rotor terminations 41 protrude beyond the lower surface of base 11.

Figure 6:
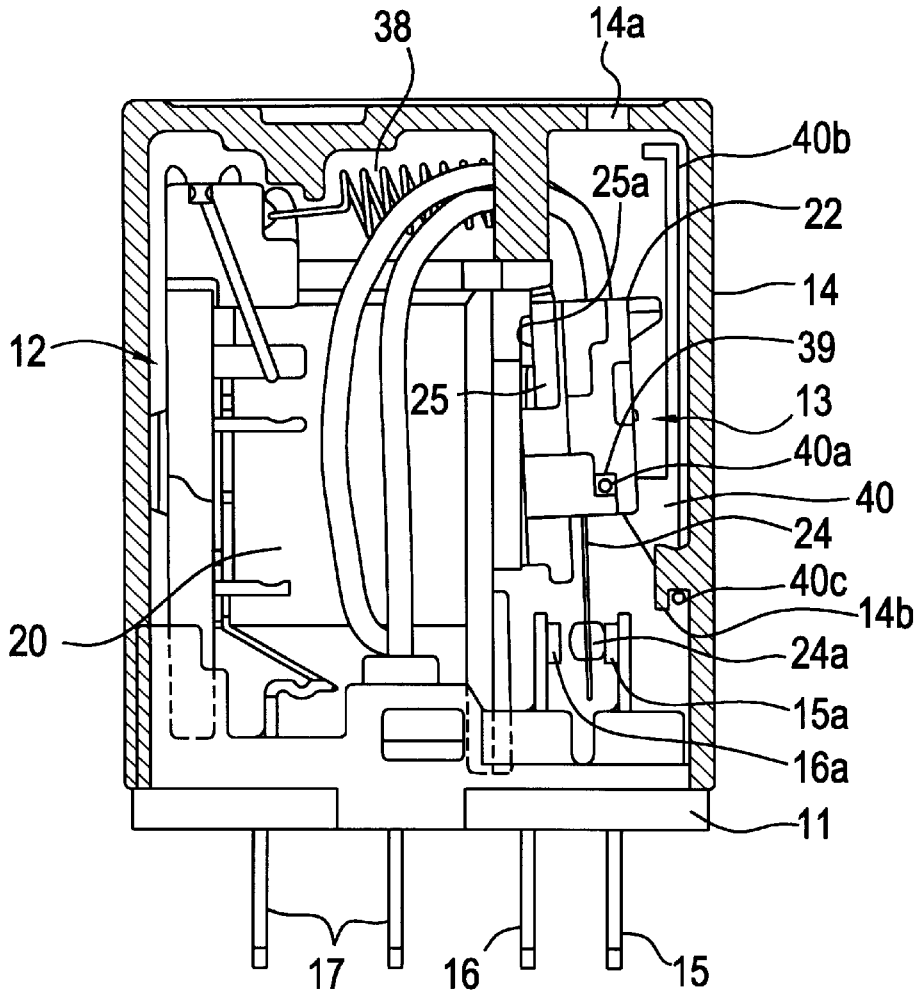
FIG. 6 illustrates a cross section of the electromagnetic relay in the ideal embodiment of this invention.

As shown in FIGS. 1 and 6, case 14 is shaped like a box with no bottom. When it is installed on base 11, it encloses all the above-mentioned structural components. On both sides of the top surface of case 14, near its edges, are windows 14*a*. These are made of a transparent material so that a user may view arms 40*a* of operating indicator 40. On the inner surface of one of the side walls of case 14 is a stop

14*b* for controlling the rotation of the movable component. When the movable component 22 rotates, shaft 40*c* of operating indicator 40 hits stop 14*b* so that its position can be controlled.

The electromagnetic relay described above operates in the following manner. Referring to FIG. 6, when coil block 12 is not magnetically excited so that no current flows to coil 20, the force of spring 38 causes movable block 13 to rotate counterclockwise. Movable contacts 24*a* touch fixed contacts 15*a*. As explained earlier, the positional relationship between movable contact elements 24, or more specifically, movable contacts 24*a*, and adsorbent surface 25*a* of movable iron member 25 is determined with a great deal of precision. As a result, the distance between movable contacts 24*a* and fixed contacts 15*a* does not vary.

When current flows into coil 20 and coil block 12 is excited, the movable iron member 25 of movable block 13 is drawn toward the surface of the end of core 19. Movable component 22 rotates clockwise in FIG. 6, and movable contacts 24*a* move over to touch fixed contacts 16*a*. As discussed earlier, the positional relationship between movable contact element 24, or more specifically, movable contacts 24*a*, and adsorbent surface 25*a* of movable iron member 25 is determined with a great deal of precision. As a result, the contact pressure between movable contacts 24*a* and fixed contacts 16*a* does not vary, and the desired value can be attained.

As the movable component 22 rotates, operating indicator 40 is moved to the left in FIG. 6. Its movement is halted when its shaft 40*c* comes up against stop 14*b* on case 14. Indicator 40, then, rotates counterclockwise on shaft 40*a*, and the tops of arms 40*b* end up just below windows 15*a* in case 14, where they are visible from the exterior. This allows the user to determine whether movable component 22 is operating properly.

In the embodiment described above, the first and second retainer portions 28 and 29 are combined in the secondary molding process. It is also possible, however, to attach these retainer portions in the following way.

Figure 7:
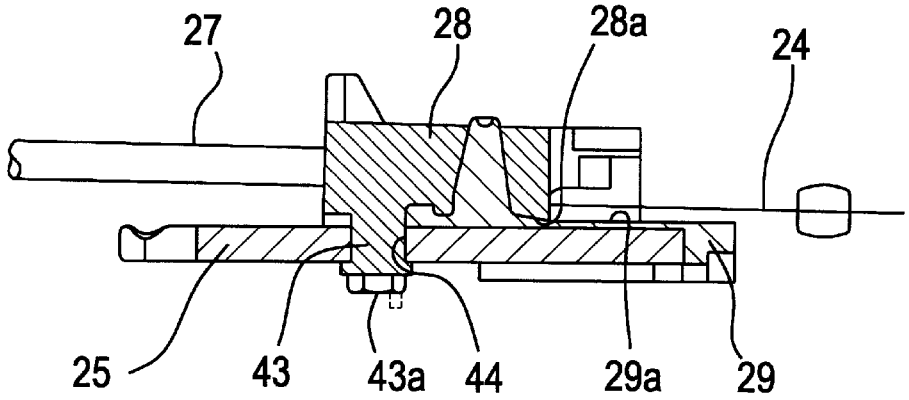
FIG. 7 illustrates a partial cross section showing another example of how the two retainer portions might be attached.

As shown in FIG. 7, a projection 43 is provided on the first retainer portion 28, and a hole 44 is created in the second retainer portion 29 and movable iron member 25, into which this projection is fitted. (Or, alternatively, a hole is provided in the first retainer portion 28 and a projection molded on the second retainer portion 29 and member 25.) Projection 43 has a depression 43*a* on its end so that it can be caulked. Just as with the previous embodiment, the first and second retainer portions 28 and 29 are positioned so that their surfaces 28*a* and 29*a* are in contact with each other and then attached. Projection 43 is then inserted through hole 44 so that it protrudes beyond the surface on the other side. The protruding portion is then thermally caulked to permanently attach the first and second retainer portions 28 and 29. The depression 43*a* has a tip such that when it is thermally caulked, it easily spreads to the edges of hole 44 to ensure a secure attachment.

In this embodiment, the first and second retainer portions 28 and 29 are thermally caulked together to form a single component; it is also possible to fasten the two portions together simply by caulking the tip of projection 43.

Figure 8:
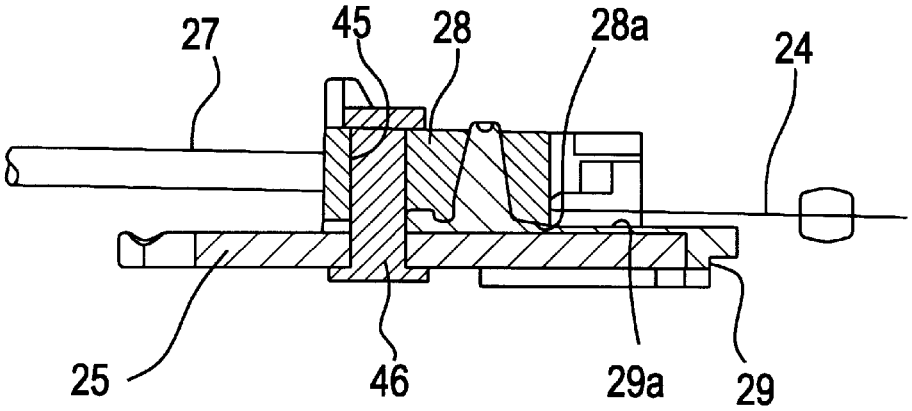
FIG. 8 illustrates a partial cross section showing still another example of how the two retainer portions might be attached.
Figure 9:
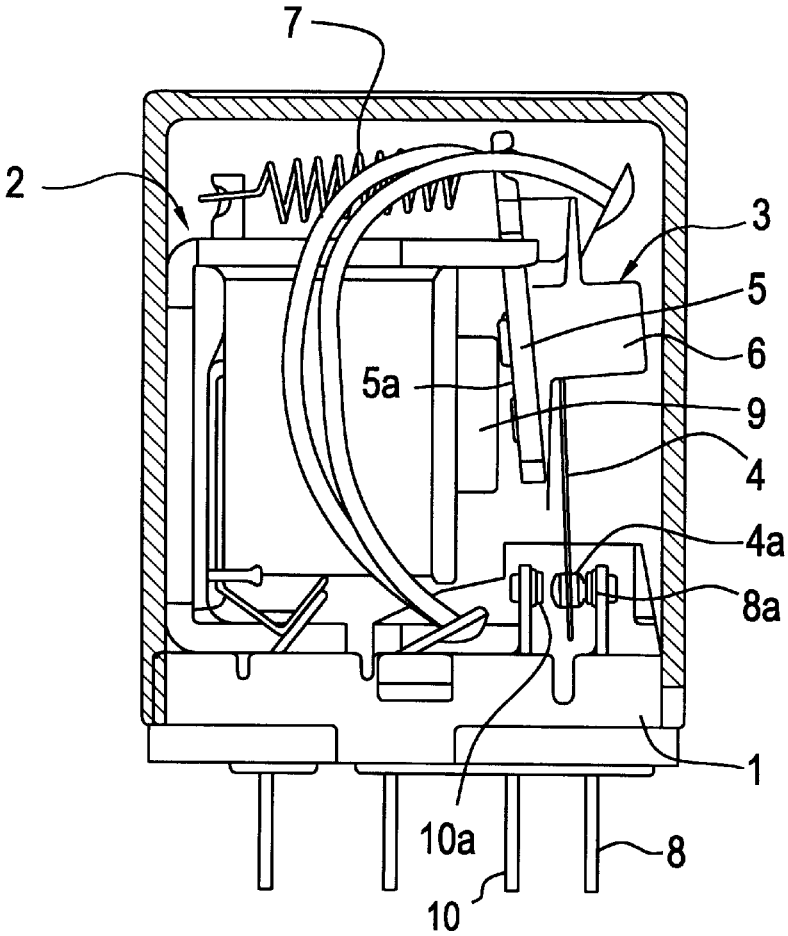
FIG. 9 PRIOR ART
FIG. 9 illustrates a cross section of an electromagnetic relay of the prior art.
Figure 10A:
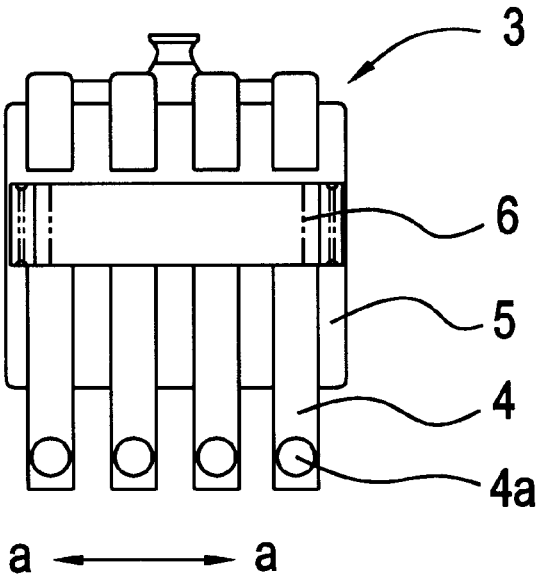
FIG. 10A PRIOR ART
FIG. 10(*a*) is a frontal view of the movable component in FIG. 9.
Figure 10B:
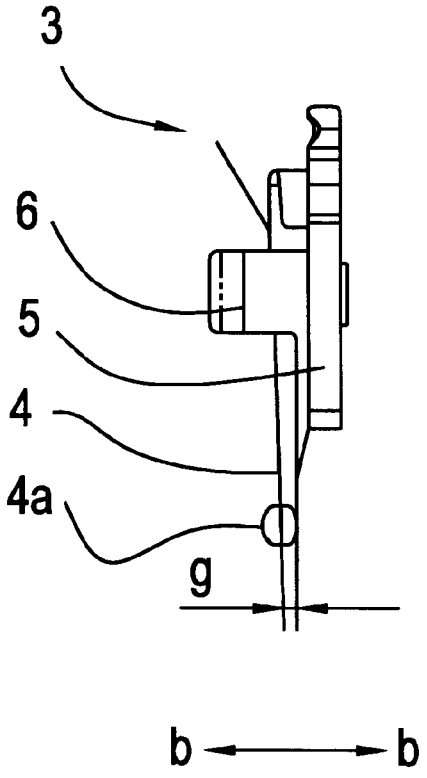
FIG. 10B PRIOR ART

In yet another embodiment, as illustrated in FIG. 8, there is shown a hole 45 going through both the first and second retainer portions 28 and 29. Just as described above, the contacting surfaces 28*a* and 29*a* of the first and second retainer portions 28 and 29, respectively, are placed together and the portions attached to one another. A rivet 46 is then inserted through the hole 45, and both its ends are caulked to form the first and second retainer portions 28 and 29 into a single piece.

As should be clear from the above explanation, the electromagnetic relay according to this invention is constructed using a component which comprises both a movable contact element and a movable iron member. This component comprises two portions of a retainer, one of which retains the movable contact element and the other retains the movable iron member. This design obviates the need for a sliding core in the molding process, which is a requirement in the prior art. Consequently, a simpler mold can be used, resulting in a lower production cost. The molding process which produces the second retainer portion absorbs any imperfections which may have occurred in processing the surface of the movable iron member. As a result, the finished relay has an extremely high degree of precision.

If the two portions of the retainer are to be attached in a secondary molding process, a small projection is provided on one of the pieces and a small hole is provided on the other to serve as a temporary anchor. When the projection is engaged in the hole, the pieces cannot slip apart in the secondary molding process, and the quality of the work is improved.

Support holes are provided through tabs on both retainer portions into which a shaft of an operating indicator is inserted. The indicator is seated in the holes in a way that it is free to rotate. This design provides a simple and inexpensive way for the indicator to be made integral to the relay.

While the invention has been described in detail with reference to a preferred embodiment and selected variations thereof, it should be apparent to those skilled in the art that many modifications and variations are possible without departure from the scope and spirit of this invention as defined in the appended claims.

What is claimed is:

1. An electromagnetic relay, comprising:

a movable component; and a coil block having an end for supporting said movable component and for allowing said movable component to freely rotate, wherein said movable component comprises a movable contact element and a movable iron member which are integrally formed with each other by a retainer, said retainer comprises a first retainer portion for holding said movable contact element in place and a second retainer portion for holding said movable iron member in place, said first and second retainer portions are formed as a single piece so as to isolate said movable contact element and said movable iron member from each other.

2. An electromagnetic relay according to claim 1, wherein said first and second retainer portions are formed into the single piece by molding said first and second retainer portions together in a molding process.

3. An electromagnetic relay according to claim 1, wherein one of said first or second retainer portion further comprises a projection which serves as a provisional anchor and which engages in a hole provided on the other of the first or second retainer portion to fasten said first and second retainer portions together prior to molding.

4. An electromagnetic relay according to claim 1, wherein one of said first or second retainer portion further comprises a projection which is inserted into a hole on the other of the first or second retainer portion forming a gap between the projection and the hole, said gap then being caulked to form said first and second retainer portions into the single piece.

5. An electromagnetic relay according to claim 1, wherein one of said first or second retainer portion further comprises a projection having a depression on an end, said projection is inserted into a hole on the other of the first or second retainer portion and said depression is thermally caulked to form said first and second retainer portions into the single piece.

6. An electromagnetic relay according to claim 1, further comprising a rivet which is inserted through holes which have been cut through both said first and second retainer portions forming a gap between said rivet and said holes, said gap is caulked to form said first and second retainer portions into the single piece.

7. An electromagnetic relay according claim 1, wherein support holes are provided for projections in said first and second retainer portions, said support holes surround and hold a shaft of an indicator in a way that said indicator can freely rotate.

8. A movable component for use in an electromagnetic relay, comprising:

a movable contact element; and a movable iron member, wherein said movable contact element and said movable iron member are integrally formed with each other by a retainer, said retainer comprises a first retainer portion for holding said movable contact element in place and a second retainer portion for holding said movable iron member in place, said first and second retainer portions are formed as a single piece so as to isolate said movable contact element and said movable iron member from each other.

* * * * *